US011495447B2

(12) United States Patent
Nishiguchi

(10) Patent No.: US 11,495,447 B2
(45) Date of Patent: Nov. 8, 2022

(54) IONIZER AND MASS SPECTROMETER

(71) Applicant: SHIMADZU CORPORATION, Kyoto (JP)

(72) Inventor: Masaru Nishiguchi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/967,343

(22) PCT Filed: Feb. 6, 2018

(86) PCT No.: PCT/JP2018/004080
§ 371 (c)(1),
(2) Date: Aug. 4, 2020

(87) PCT Pub. No.: WO2019/155530
PCT Pub. Date: Aug. 15, 2019

(65) Prior Publication Data

US 2021/0375609 A1 Dec. 2, 2021

(51) Int. Cl.
*H01J 49/14* (2006.01)
*H01J 49/04* (2006.01)
(Continued)

(52) U.S. Cl.
CPC ..... *H01J 49/147* (2013.01); *H01J 27/205* (2013.01); *H01J 49/0422* (2013.01); *H01J 49/401* (2013.01); *H01J 49/4215* (2013.01)

(58) Field of Classification Search
CPC .... H01J 49/147; H01J 49/0422; H01J 49/401; H01J 49/4215
See application file for complete search history.

(56) References Cited

U.S. PATENT DOCUMENTS 5,118,939 A * 6/1992 Ishihara ..... H01J 49/322 250/296
6,958,475 B1 * 10/2005 Colby ..... H01J 49/147 977/939
(Continued)

FOREIGN PATENT DOCUMENTS

JP 54-78198 A 6/1979
JP 62-129760 U 8/1987
(Continued)

OTHER PUBLICATIONS

International Search Report for PCT/JP2018/004080 dated Apr. 3, 2018 (PCT/ISA/210).
(Continued)

*Primary Examiner* — David E Smith
(74) *Attorney, Agent, or Firm* — Sughrue Mion, PLLC

(57) ABSTRACT

An ionizer 1 including an ionization chamber 10, a sample gas introduction port 14 provided in the ionization chamber 10 for introducing sample gas, an electron beam emitting section 11 which emits an electron beam toward the ionization chamber 10, electron beam passage openings 10*a* and 10*b* which are formed on a path of the electron beam emitted from the electron beam emitting section 11 on a wall of the ionization chamber 10 and has a length in a direction of the path longer than a width of a cross section orthogonal to the direction, and an ion outlet 10*c* provided in the ionization chamber 10 for emitting an ion of the sample gas generated by irradiation with the electron beam, and a mass spectrometer 60 including the ionizer 1.

12 Claims, 7 Drawing Sheets

(51) Int. Cl.

| | |
|---|---|
| ***H01J 49/40*** | (2006.01) |
| ***H01J 49/42*** | (2006.01) |
| ***H01J 27/20*** | (2006.01) |

(56) References Cited

U.S. PATENT DOCUMENTS

| | | | | |
|---|---|---|---|---|
| 2006/0016978 | A1* | 1/2006 | McCauley | H01J 49/429 250/288 |
| 2008/0073556 | A1* | 3/2008 | Kawana | H01J 49/10 250/423 R |
| 2009/0194679 | A1* | 8/2009 | Doherty | H01J 49/0045 250/288 |
| 2012/0286152 | A1* | 11/2012 | Jones | H01J 49/145 427/523 |
| 2016/0247669 | A1* | 8/2016 | Tateishi | H01J 49/067 |
| 2017/0110311 | A1* | 4/2017 | Reilly | H01J 49/429 |
| 2017/0287691 | A1 | 10/2017 | Asano | |
| 2018/0315588 | A1 | 11/2018 | Nishiguchi et al. | |
| 2020/0294751 | A1* | 9/2020 | Tootell | H01J 27/205 |

FOREIGN PATENT DOCUMENTS

| | | | | |
|---|---|---|---|---|
| JP | 62129760 | U * | 8/1987 | |
| JP | 62129760 | U * | 8/1987 | |
| JP | 02-304854 | A | 12/1990 | |
| JP | 2009-210482 | A | 9/2009 | |
| JP | 2016-157523 | A | 9/2016 | |
| WO | WO-2007102204 | A1 * | 9/2007 | G01N 27/62 |
| WO | 2016/042627 | A1 | 3/2016 | |
| WO | 2017/022125 | A1 | 2/2017 | |

OTHER PUBLICATIONS

Written Opinion for PCT/JP2018/004080 dated Apr. 3, 2018 (PCT/ISA/237).

* cited by examiner

IONIZER AND MASS SPECTROMETER

CROSS REFERENCE TO RELATED APPLICATIONS

This application is a National Stage of International Application No. PCT/JP2018/004080 filed Feb. 6, 2018.

TECHNICAL FIELD

The present invention relates to an ionizer for ionizing sample gas, and, more specifically, relates to an ionizer that ionizes sample gas by an electron ionization (EI) method, a chemical ionization (CI) method, or a negative chemical ionization (NCI) method. Further, the present invention relates to a mass spectrometer equipped with such an ionizer.

BACKGROUND ART

A mass spectrometer that ionizes and analyzes sample gas, such as a gas chromatograph mass spectrometer (GC-MS), uses an ionizer that ionizes sample gas by an electron ionization method, a chemical ionization method, or a negative chemical ionization method. In the electron ionization method, sample gas is introduced into an ionization chamber and irradiated with an electron beam so that molecules of the sample gas are ionized (for example, Patent Literature 1). In the chemical ionization method, reaction gas is introduced into an ionization chamber together with sample gas and irradiated with an electron beam so that molecules of the reaction gas are ionized, and, furthermore, the ions react with molecules of the sample gas so that molecules of the sample gas are ionized. The negative chemical ionization has a plurality of ionization mechanisms. For example, a thermion is captured by a molecule of sample gas and a negative ion is generated. The generated ions are transported to a mass separation unit such as a quadrupole mass filter, and separated and detected according to a mass-to-charge ratio.

FIG. 1 shows a schematic configuration of a conventional ionizer 100 which ionizes sample gas by an electron ionization method. In this ionizer 100, sample gas is introduced into an ionization chamber 110 disposed in a vacuum chamber (not shown) for ionization. The ionization chamber 110 has a box shape formed by combining plate-shaped members. Two filaments 111 and 112 are disposed outside the ionization chamber 110 with the ionization chamber 110 between them. At the time of use, a predetermined current is supplied to one filament 111 to generate thermions, which are emitted toward the other filament 112. On a wall of the ionization chamber 110, electron beam passage openings 110*a* and 110*b* are formed on the path of the electron beam connecting these filaments 111 and 112. Further, an ion outlet 110*c* is formed on another wall of the ionization chamber 110, and an ion transport optical system 120 for converging ions extracted from the ionization chamber 110 and transporting them to a mass separation unit or the like is disposed on an outer side of the ion outlet 110*c*. A repeller electrode 113 is disposed in the ionization chamber 110, and, by applying a DC voltage having the same polarity as an ion to be measured to the repeller electrode 113, an electric field for pushing the ion toward the ion outlet 110*c* is formed in the ionization chamber 110. In this manner ions are emitted from the ionization chamber 110.

CITATION LIST

Patent Literature

Patent Literature 1: JP 2016-157523 A
Patent Literature 2: JP 2009-210482 A

SUMMARY OF INVENTION

Technical Problem

Improvement in measurement sensitivity is required for a mass spectrometer. In the above-mentioned electron ionization method, molecules of sample gas existing in the ionization chamber 110 are irradiated with an electron beam to generate ions. In order to increase the amount of generated ions to improve the measurement sensitivity, the density in the number of molecules (number density) of the sample gas in the ionization chamber 110 may be made higher.

Since the sample gas introduced into the ionization chamber 110 flows out from the electron beam passage openings 110*a* and 110*b* or the ion outlet 110*c*, the number density of molecules in the ionization chamber 110 can be made higher by reducing the size of these openings. However, if the electron beam passage openings 110*a* and 110*b* are made smaller, the amount of the electron beam incident in the ionization chamber 110 decreases. Accordingly, even if the number density of molecules of the sample gas in the ionization chamber 110 increases, the amount of generated ions does not increase. Further, when the ion outlet 110*c* is made smaller, the amount of sample gas flowing out from the ionization chamber 110 decreases, the number density of molecules in the ionization chamber 110 increases, and the amount of generated ions increases. However, since the amount of ions discharged from the ionization chamber 110 decreases, the measurement sensitivity is not improved. That is, improving the measurement sensitivity is difficult even if the electron beam passage openings 110*a* and 110*b* or the ion outlet 110*c* are/is made smaller to make the number density of molecules in the ionization chamber 110 higher.

Here, the case of the ionizer using the electron ionization method has been described as an example. The issue of the case may generally apply to an ionizer using the chemical ionization method or the negative chemical ionization method in which sample gas is ionized using an electron beam similarly to the electron ionization method.

A problem to be solved by the present invention is to provide an ionizer capable of improving measurement sensitivity of ions generated from sample gas. Further, a problem to be solved by the present invention is to provide a mass spectrometer equipped with such an ionizer.

Solution to Problem

An ionizer according to the present invention to solve the problem includes:

a) an ionization chamber;

b) a sample gas introduction port provided in the ionization chamber for introducing sample gas;

c) an electron beam emitting section which emits an electron beam toward the ionization chamber;

d) an electron beam passage opening which is formed on a path of the electron beam emitted from the electron beam emitting section on a wall of the ionization chamber and has a length in a direction of the path longer than a width of a cross section orthogonal to the direction; and e) an ion outlet provided in the ionization chamber for emitting an ion of the sample gas generated by irradiation with the electron beam.

The cross-sectional shape of the electron beam passage opening is, for example, circular, and in that case, the width is defined by the diameter. However, in the present invention, the electron beam passage opening is not limited to a circular shape, and may be an elliptical shape or a polygonal shape. For example, in a case where the electron beam emitting section has a filament long in a direction orthogonal to an emission direction of the electron beam, an electron beam having a cross section long in the direction is generated, and, for this reason, a rectangular or elliptical electron beam passage opening long in the direction is preferably formed. The ionizer according to the present invention is based on a technical idea of reducing the conductance of molecular flow in the electron beam passage opening as described later, and, in a case where the cross section of the electron beam passage opening has a shape other than a circle (elliptical shape, a rectangular shape, or the like) as described above, the "width" is defined by the length corresponding to the diameter of a circle having the same cross-sectional area.

The ionizer according to the present invention is characterized in that the electron beam passage opening provided in the ionization chamber has a length in a direction in which an electron beam passes longer than a width of a cross section orthogonal to the direction. The ionization chamber used in the conventional ionizer is a combination of plate-shaped members. The thickness of the plate-shaped member is, for example, 1 mm or less, and the diameter of the electron beam passage opening formed on the plate-shaped member is, for example, about 3 mm. That is, in the conventional ionizer, the length of the electron beam passage opening formed in the ionization chamber in the direction in which the electron beam passes is shorter than a width of a cross section orthogonal to the direction. On the other hand, in the ionizer according to the present invention, for example, a plate-shaped member having a thickness of 5 mm is used to form the electron beam passage opening having a diameter of about 3 mm as in the conventional ionizer. In this manner, the conductance of molecular flow at the electron beam passage opening is reduced as compared to the conventional ionizer, and outflow of sample gas from the ionization chamber is suppressed. As a result, the number density of molecules of the sample gas in the ionization chamber increases. In the ionizer according to the present invention, the width of the electron beam passage opening formed in the ionization chamber may be the same as one in the conventional ionizer. Since, in that case, the amount of an electron beam incident in the ionization chamber does not decrease, the amount of generated ions increases. Further, the ion outlet may be the same as one in the conventional ionizer. In that case, the amount of ions emitted from the ionization chamber does not decrease, and the measurement sensitivity is improved.

In the ionizer according to the present invention, two of the electron beam passage openings are preferably symmetrically formed with the center of internal space of the ionization chamber between them. In this case, for example, a filament may be disposed at each of the electron beam passage openings. If one of the filaments used as an electron beam emitting section fails, the other filament can be used as the electron beam emitting section. Further, since two of the electron beam passage openings are disposed at equivalent positions, an equivalent configuration can be maintained even if the filaments are switched.

The ionizer according to the present invention can be preferably used as an ionization unit of a mass spectrometer.

Advantageous Effects of Invention

By using the ionizer or the mass spectrometer equipped with the ionizer according to the present invention, measurement sensitivity of an ion generated from sample gas can be improved.

DESCRIPTION OF EMBODIMENTS

Figure 1:
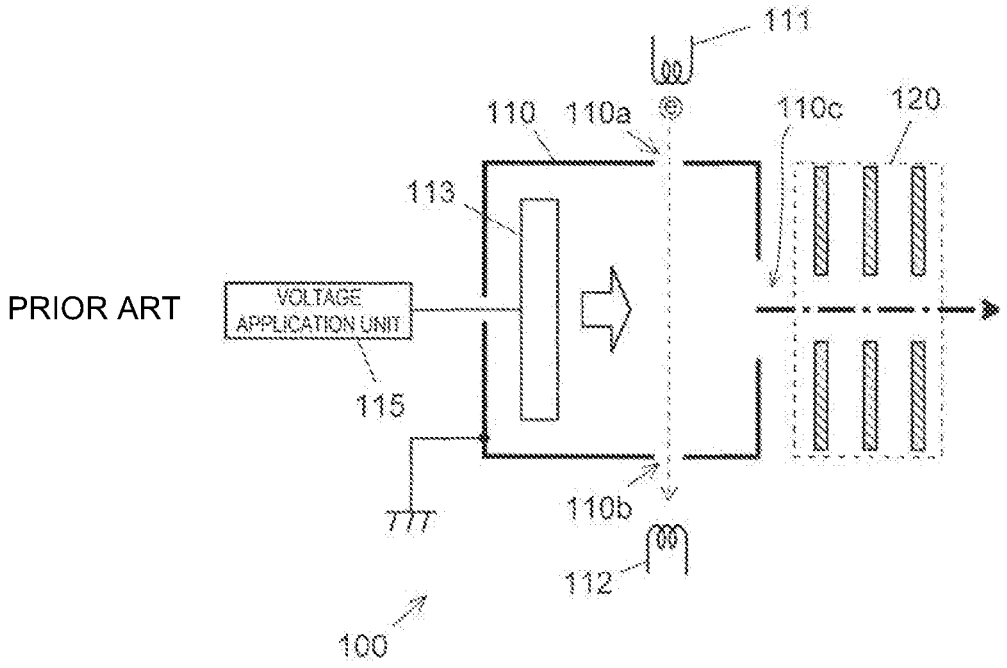
FIG. 1 is a schematic configuration diagram of a conventional ionizer.
Figure 2:
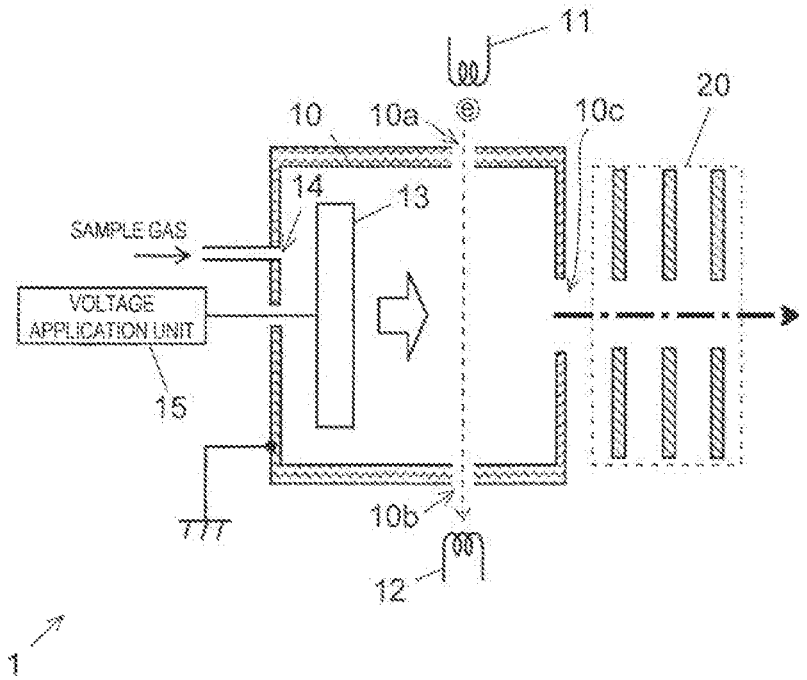
FIG. 2 is a schematic configuration diagram of an embodiment of an ionizer according to the present invention.
Figure 3:
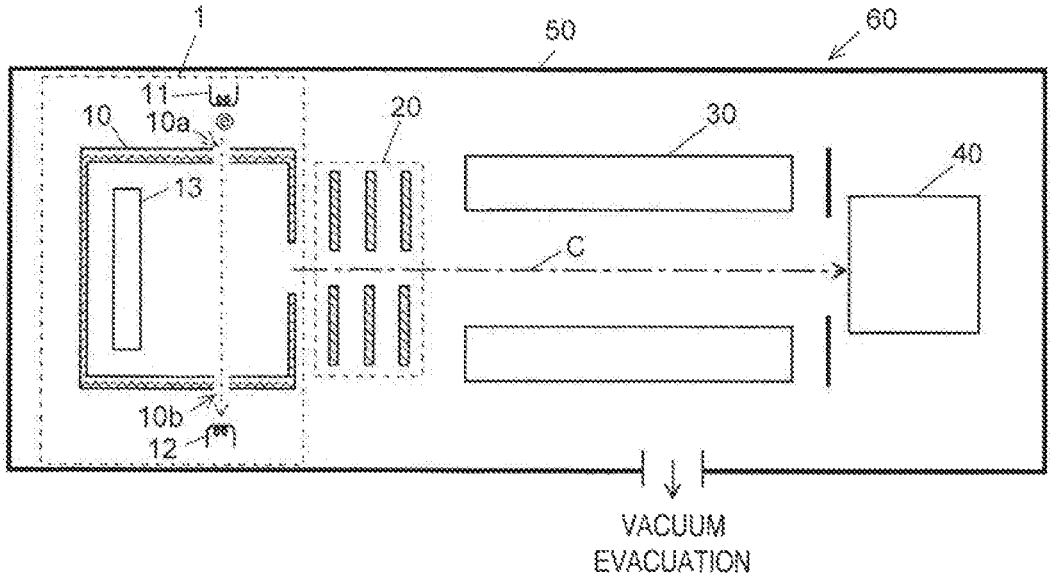
FIG. 3 is a schematic configuration diagram of a quadrupole mass spectrometer which is an embodiment of a mass spectrometer according to the present invention.

An embodiment of an ionizer according to the present invention and a quadrupole mass spectrometer which is an embodiment of a mass spectrometer equipped with the ionizer of the embodiment will be described below with reference to the drawings. FIG. 2 is a configuration diagram of a main part of an ionizer 1 of the present embodiment and an ion transport optical system 20 disposed in a subsequent stage, and FIG. 3 is a configuration diagram of a main part of a quadrupole mass spectrometer 60 equipped with the ionizer 1 of the present embodiment.

The ionizer 1 of the present embodiment is a device which ionizes sample gas introduced into an ionization chamber 10 by an electron ionization method. The ionization chamber 10 has a box shape formed by combining plate-shaped members. On the outside of the ionization chamber 10, two filaments 11 and 12 having the same shape are disposed by sandwiching the ionization chamber 10. On a wall of the ionization chamber 10, electron beam passage openings 10*a* and 10*b* are formed on a path of an electron beam from the one filament 11 to the other filament 12. Further, a sample gas introduction port 14 is disposed on another wall of the ionization chamber 10, and sample gas is introduced into the ionization chamber 10 through the sample gas introduction port 14. Furthermore, an ion outlet 10*c* is formed on still another wall of the ionization chamber 10, and an ion transport optical system 20 for converging ions extracted from the ionization chamber 10 and transporting them to a mass separation unit or the like is disposed on an outer side of the ion outlet 10*c*. A repeller electrode 13 is disposed in the ionization chamber 10, and, by applying a DC voltage having the same polarity as an ion to be measured from a voltage application unit 15 to the repeller electrode 13, a pushing electric field for pushing the ion toward the ion outlet 10*c* is formed in the ionization chamber 10. In this manner an ion is emitted from the ionization chamber 10. In the ionizer 1 of the present embodiment, the two filaments 11 and 12 are symmetrically disposed with the center of internal space of the ionization chamber 10 between them, and the two electron beam passage openings 10*a* and 10*b* are formed symmetrically with the center of the internal space of the ionization chamber 10 between them. In the ionizer 1 of the present embodiment, the filament 11 and the electron beam passage opening 10*a*, and the filament 12 and the electron beam passage opening 10*b* are disposed at equivalent positions as described above. In this manner, in a case where the one filament 11 used as an electron beam emitting section fails, the other filament 12 can be used as the electron beam emitting section.

In the ionizer 1 of the present embodiment, among the plate-shaped members forming the ionization chamber 10, for a plate-shaped member on which the electron beam passage openings 10*a* and 10*b* are formed, one that is thicker than the plate-shaped members forming the other walls is used. The ionizer 1 of the present embodiment is characterized in that each of the electron beam passage openings 10*a* and 10*b* formed on those plate-shaped members has a length in a direction of a path of an electron beam which is greater than a width of a cross section orthogonal to the direction. Specifically, a through hole having a cross section of 2 mm-by-4 mm is formed on each of two plate-shaped members having a thickness of 5 mm, and these are used as the electron beam passage openings 10*a* and 10*b*. A cross-sectional shape of the through hole of 2 mm-by-4 mm corresponds to an outer shape of the filaments 11 and 12. In the present embodiment, a long rectangular opening is formed in a longitudinal direction of the filaments 11 and 12. However, in a case where an electron beam emitting section other than the filaments 11 and 12 is used, an opening having an appropriate shape corresponding to an outer shape of the section may be used as the electron beam passage openings 10*a* and 10*b*. Note that, in a case where the electron beam passage openings 10*a* and 10*b* have a cross-sectional shape other than a circular shape as in the present embodiment, a width of the shape is defined by a length corresponding to a diameter of a circle having the same cross-sectional area. That is, in the case of the present embodiment, the width of the electron beam passage openings 10*a* and 10*b* is defined as $2\times(8/\pi)^{1/2}$(=about 3 mm), which is a diameter of a circle having an area of 8 $mm^2$.

The quadrupole mass spectrometer 60 of the present embodiment is what is called a single quadrupole mass spectrometer including the ionizer 1 and the ion transport optical system 20 shown in FIG. 2 disposed in a chamber 50 maintained at a predetermined vacuum degree by a vacuum pump (not shown), and a quadrupole mass filter 30 and an ion detector 40 disposed on a downstream side of the ion transport optical system 20. Note that, in FIG. 3, illustration of the sample gas introduction port 14 and the like is omitted, and the ionizer 1 is illustrated in a simplified manner. Similarly, in FIGS. 6 to 9 described later, the ionizer 1 is illustrated in a simplified manner.

In the ionizer 1 included in the quadrupole mass spectrometer 60 of the present embodiment, for example, sample gas containing a sample component temporally separated in a column of a gas chromatograph is introduced into the ionization chamber 10 through the sample gas introduction port 14. A current is supplied from a power source (not shown) to the one filament 11 used as an electron beam emitting section. In this manner, the filament 11 is heated and a thermion is generated. The thermion generated in the filament 11 is accelerated by a potential difference between the filament 11 and the other filament 12 to each of which a predetermined voltage is applied, and directed toward the other filament 12. That is, an electron beam is emitted from the one filament 11 which is an electron beam emitting section toward the other filament 12. Molecules of sample gas introduced into the ionization chamber 10 come into contact with the thermion to be ionized. The generated ion is emitted from the ion outlet 10*c* by an effect of an electric field formed in the ionization chamber 10 by application of a DC voltage of the same polarity as an analysis target ion from the voltage application unit 15 to the repeller electrode 13, and introduced into the ion transport optical system 20.

The ion transport optical system 20 is composed of a plurality of ring-shaped electrodes. Ions are converged in the vicinity of an ion optical axis C by application of a DC voltage and/or a high-frequency voltage of appropriate polarity and magnitude to each of a plurality of the ring-shaped electrodes, and transported to the quadrupole mass filter 30 disposed in a subsequent stage. The quadrupole mass filter 30 is composed of four rod electrodes. An ion having a predetermined mass-to-charge ratio is selected from other ions by application of a DC voltage and/or a high-frequency voltage of appropriate polarity and magnitude to each of these four rod electrodes, reaches the ion detector 40 in a subsequent stage, and is detected. In the quadrupole mass spectrometer 60 of the present embodiment, MS scanning measurement can be performed by scanning a mass-to-charge ratio within a predetermined mass-to-charge range, and selective ion monitoring (SIM) measurement can be performed by fixing the predetermined mass-to-charge ratio.

The ionizer 1 of the present embodiment has a configuration characterized in that electron beam passage openings 10*a* and 10*b* have a length in a direction of a path of an electron beam which is greater than a width of a cross section orthogonal to the direction. This point will be described in detail.

In the conventional ionizer, in order to reduce a weight of the device, thin (for example, 0.5-mm thick) plate-shaped members are combined to form an ionization chamber, and two openings with a diameter of, for example, about 3 mm are formed on a path of an electron beam and used as electron beam passage openings.

On the other hand, in the ionizer 1 of the present embodiment, based on a technical idea that measurement sensitivity is improved by making the number density of molecules in the ionization chamber 10 higher and increasing an amount of generated ions, ones having a thickness of 5 mm are used for two plate-shaped members facing the filaments 11 and 12, and through holes having a rectangular cross section of 2 mm-by-4 mm are formed as described above and used as the electron beam passage openings 10*a* and 10*b*.

In a case where the ionizer 1 is disposed in the chamber 50 maintained in vacuum like the quadrupole mass spectrometer 60 of the present embodiment, flow of sample gas is molecular flow since an average free path of a molecule in the ionization chamber 10 is long. A cross section of the electron beam passage openings 10*a* and 10*b* in the ionizer 1 of the present embodiment, which is rectangular, is approximate to a circle for ease of explanation. A circular tube conductance in a molecular flow region is proportional to the cube of a radius of its cross section and inversely proportional to a tube length. In the ionizer 1 of the present embodiment, the electron beam passage openings 10*a* and 10*b* have a length (5 mm) which is ten times the length (0.5 mm) of the electron beam passage opening in the conventional ionizer, and the conductance is suppressed to one-tenth or less. In this manner, the number density of molecules in the ionization chamber 10 is made higher than that in the conventional ionizer.

Note that, considering only the conductance to be small, reducing inner diameters of the electron beam passage openings is more efficient than lengthening them. However, if the inner diameters of the electron beam passage openings are made smaller, the amount of the electron beam incident in the ionization chamber decreases. Accordingly, even if the number density of molecules of the sample gas in the ionization chamber increases, the amount of generated ions does not increase.

Alternatively, it is conceivable to increase the number density of molecules in the ionization chamber by reducing the conductance of an ion outlet by lengthening the ion outlet or decreasing the inner diameter. However, in that case, the amount of ions emitted from the ionization chamber also decrease, and the measurement sensitivity is not improved.

In the ionizer 1 of the present embodiment, the inner diameters of the electron beam passage openings 10*a* and 10*b* formed in the ionization chamber 10 are substantially the same as the electron beam passage openings in the conventional ionizer, and the amount of an electron beam incident in the ionization chamber 10 does not decrease. Accordingly, the amount of generated ions is increased. Further, since the ion outlet 10*c* may be similar to one in the conventional ionizer, the amount of ions emitted from the ionization chamber 10 does not decrease. Therefore, the measurement sensitivity of ions can be improved.

In the ionizer 1 of the present embodiment, the present inventor used a length of the inner diameter of the electron beam passage openings 10*a* and 10*b* as a standard for a length by which an effect of increasing an amount of generated ions and improving the measurement sensitivity can be obtained. This is because by setting the length of the electron beam passage openings 10*a* and 10*b* to be equal to or larger than the inner diameter of them, the electron beam passage opening, which is an opening having substantially no thickness in the conventional ionizer, can be regarded as a tube having a wall along a traveling direction like a circular tube. By forming the electron beam passage openings 10*a* and 10*b* so as to satisfy the above requirement, the number density of molecules of sample gas in the ionization chamber 10 can be made higher and the amount of generated ions can be increased, so that the measurement sensitivity is improved.

Next, a simulation performed to confirm the effect obtained by using the ionizer of the present embodiment will be described. In this simulation, the number density of molecules in the ionization chamber on a path (y axis) of an electron beam was obtained for each of the ionizer of the present embodiment and the conventional ionizer (comparative example). As described above, the ionizer of the present embodiment is used in a vacuum atmosphere, and therefore sample gas behaves as a molecular flow. Accordingly, the direct simulation Monte Carlo (DSMC) method (for example, Patent Literature 2) was used for the simulation.

For both the ionizer of the present embodiment and the ionizer of the comparative example, a cross-sectional shape of the electron beam entrance and the electron beam exit was set to a rectangle of 2 mm-by-4 mm, and their length was set to 5 mm in the present embodiment and their length was set to 0.5 mm in the comparative example. Further, sample gas flow is configured to be introduced from the center of one side surface parallel to a path of an electron beam, and the origin is set to the intersection of the path of an electron beam and an introduction direction of the sample gas flow.

Figure 4:
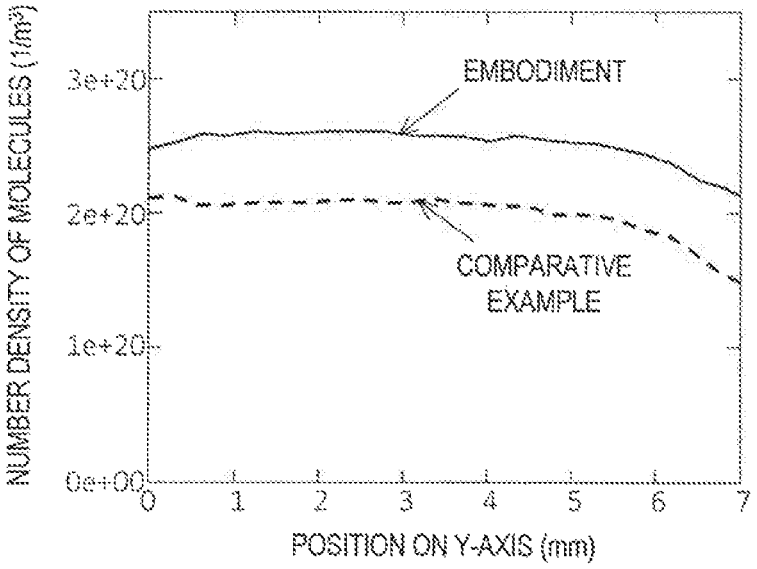
FIG. 4 shows a simulation result regarding the number density of molecules in an ionization chamber of the ionizer according to the present embodiment.

FIG. 4 shows a result of the simulation. In the comparative example, the number density of molecules of sample gas on the path of an electron beam is about $2.0\times10^{20}/m^3$. On the other hand, in the present embodiment, the number density of molecules of sample gas on the path of an electron beam is increased to about $2.5\times10^{20}/m^3$.

Further, a result of an experiment performed to confirm the effect obtained by using the ionizer of the present embodiment will be described. In this experiment, the same standard sample was introduced into gas chromatograph mass spectrometers combining a gas chromatograph with a front stage of each of the quadrupole mass spectrometer having a configuration described in FIG. 3 and a quadrupole mass spectrometer having the conventional ionizer (comparative example), and selective ion monitoring (SIM) measurement was performed on a sample component contained in the standard sample and having a retention time of about 3.95 min.

Figure 5:
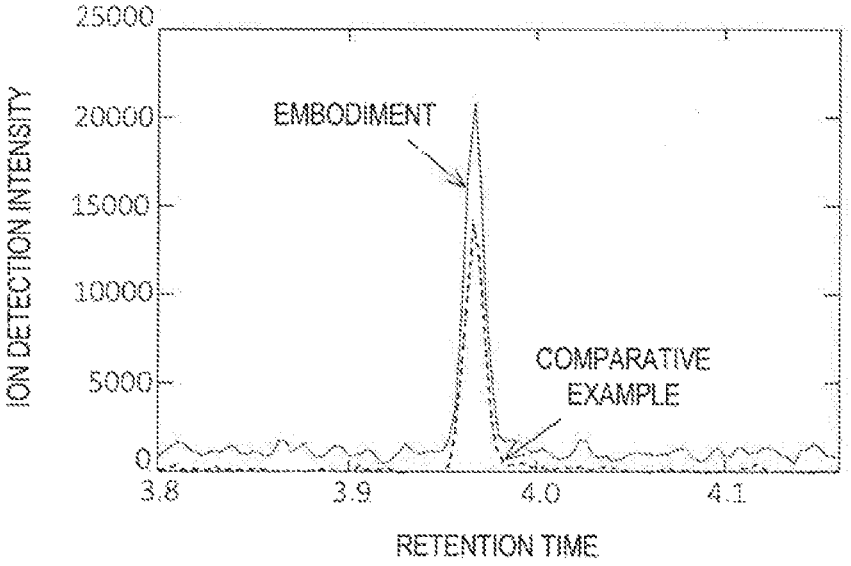
FIG. 5 shows a mass chromatogram acquired by using a gas chromatograph mass spectrometer in which the quadrupole mass spectrometer of the present embodiment is combined with a gas chromatograph.

A mass chromatogram obtained by the above experiment is shown in FIG. 5. In the comparative example, the detection intensity (optional unit common to the present embodiment and the comparative example) of ions in the mass chromatogram is about 14,000 in the comparative example. On the other hand, in the present embodiment, the detection intensity of ions is as large as about 21,000, showing that the ion measurement sensitivity is improved by about 50% compared to the conventional device.

The above embodiment is an example, and can be appropriately modified in accordance with the spirit of the present invention.

The above embodiment has the configuration, in which the two filaments 11 and 12 are symmetrically disposed with the center of internal space of the ionization chamber 10 between them, and the two electron beam passage openings 10*a* and 10*b* are formed symmetrically with the center of the internal space of the ionization chamber 10 between them. However, this configuration is not an essential configuration requirement. For example, the configuration may be such that only one of the filament 11 is disposed and only one of the ion passage port 10*a* is formed on a wall of the ionization chamber 10. Also in the ionizer of such an aspect, the conductance at the ion passage port 10*a* can be made smaller than that in the conventional device to make the number density of molecules in the ionization chamber 10 higher than in the conventional device.

The case of ionizing sample gas by using the electron ionization method has been described as an example. A configuration similar to the above can be preferably used for an ionizer using the chemical ionization method or the negative chemical ionization method in which sample gas is ionized using an electron beam similarly to the electron ionization method.

Further, although the quadrupole mass spectrometer 60 has been described in the above embodiment, the ionizer 1 of the present embodiment can be preferably used in other types of mass spectrometers. Such an example will be described with reference to FIGS. 6 to 9.

Figure 6:
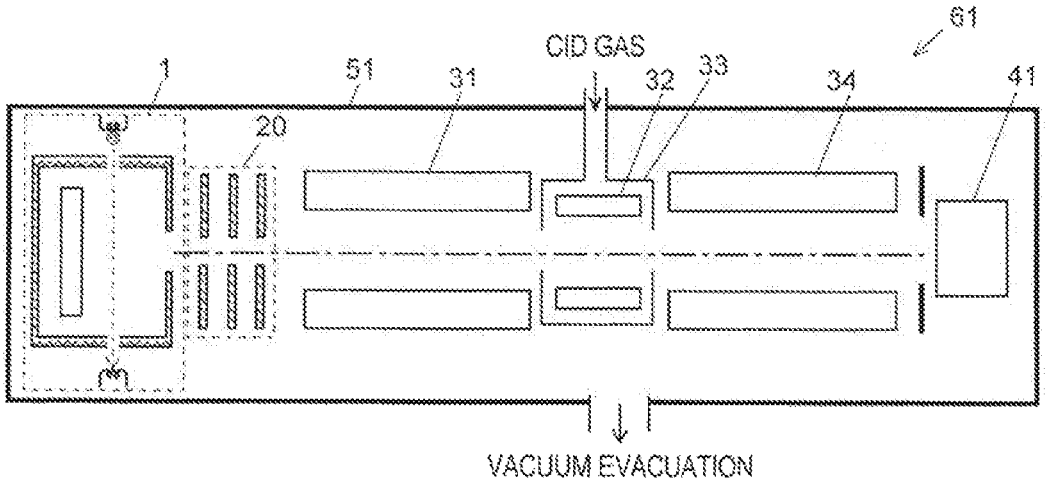
FIG. 6 is an entire configuration diagram of a triple quadrupole mass spectrometer which is another embodiment of the mass spectrometer according to the present invention.

FIG. 6 is an entire configuration diagram of what is called a triple quadrupole mass spectrometer 61, which has quadrupole mass filters at the front and rear of a collision cell. The triple quadrupole mass spectrometer 61 includes, inside a chamber 51 to be vacuum-evacuated, the ionizer 1 and the ion transport optical system 20 described above, a front-stage quadrupole mass filter 31, a collision cell (ion dissociation unit) 33 having a multipole ion guide 32 in the inside, a rear-stage quadrupole mass filter 34, and an ion detector 41.

In the triple quadrupole mass spectrometer 61, ions generated in the ionization chamber 10 are introduced into the front-stage quadrupole mass filter 31 via the ion transport optical system 20, and, for example, only an ion having a predetermined mass-to-charge ratio passes through the front-stage quadrupole mass filter 31 and is introduced into the collision cell 33 as a precursor ion. Predetermined CID gas such as argon is supplied to the collision cell 33, and the precursor ion comes into contact with the CID gas and is cleaved by collision-induced dissociation. Various product ions generated by cleavage are introduced into the rear-stage quadrupole mass filter 34, and only a product ion having a predetermined mass-to-charge ratio passes through the rear-stage quadrupole mass filter 34, reaches the ion detector 41, and is detected.

The triple quadrupole mass spectrometer 61 can perform, in addition to the above MS scan measurement and SIM measurement, product ion scan measurement, precursor ion scan measurement, neutral loss scan measurement, and multiple reaction monitoring (MRM) measurement.

Figure 7:
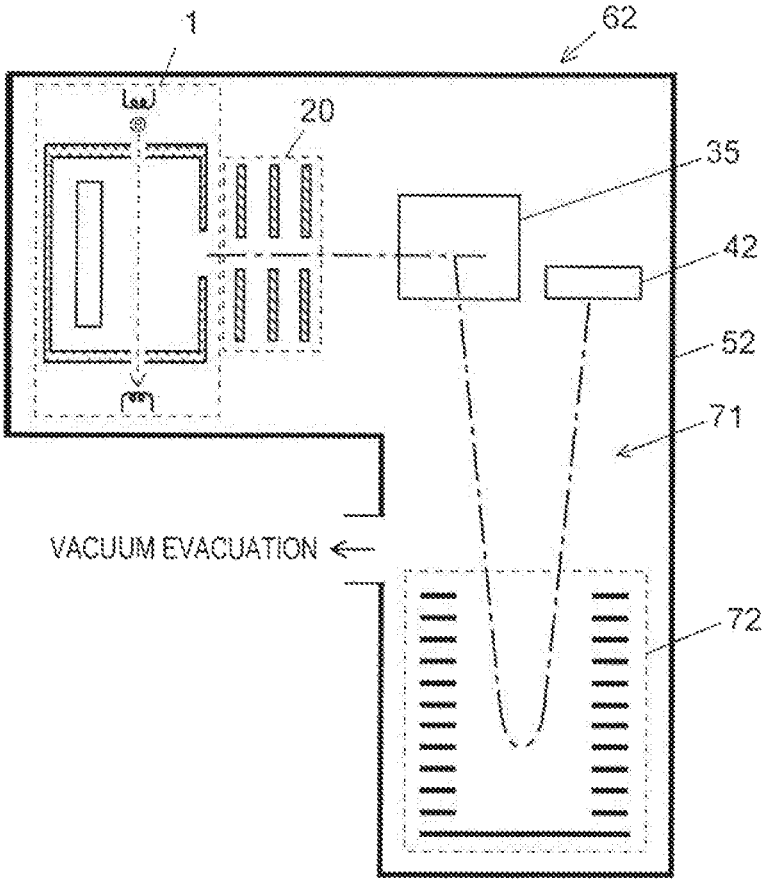
FIG. 7 is an entire configuration diagram of a time-of-flight mass spectrometer in an orthogonal acceleration system which is yet another embodiment of the mass spectrometer according to the present invention.

FIG. 7 is an entire configuration diagram of a time-of-flight mass spectrometer 62 in an orthogonal acceleration system. The time-of-flight mass spectrometer 62 in an orthogonal acceleration system includes, inside a chamber 52 to be vacuum-evacuated, the ionizer 1 and the ion transport optical system 20 described above, an orthogonal acceleration unit 35, flight space 71 including a reflector 72 in which a plurality of reflection electrodes are disposed, and an ion detector 42.

In this time-of-flight mass spectrometer, ions generated in the ionization chamber 10 are introduced into the orthogonal acceleration unit 35 via the ion transport optical system 20. The orthogonal acceleration unit 35 pulse-accelerates the introduced ions at a predetermined timing in a direction substantially orthogonal to their traveling direction and emits them into the flight space 71. The ions fly in the flight space 71, turn back on the reflector 72, and reach the ion detector 42. The ions emitted from the orthogonal acceleration unit 35 have a flight speed according to their mass-to-charge ratio. For this reason, before the ions fly and reach the ion detector 42, the ions are separated according to the mass-to-charge ratio and reach the ion detector 42 with a time lag to be detected.

Figure 8:
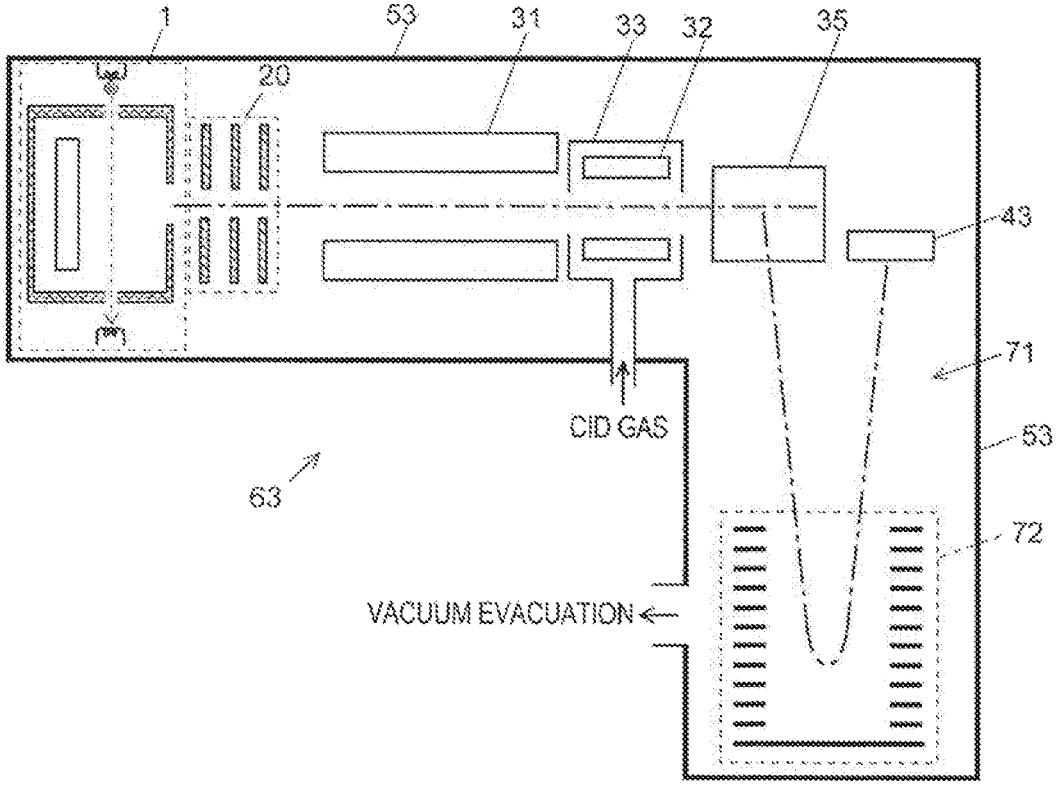
FIG. 8 is an entire configuration diagram of a quadrupole-time-of-flight mass spectrometer which is yet another embodiment of the mass spectrometer according to the present invention.

FIG. 8 is an entire configuration diagram of a quadrupole-time-of-flight (q-TOF type) mass spectrometer 63. This quadrupole-time-of-flight mass spectrometer 63 includes, inside a chamber 53 to be vacuum-evacuated, the ionizer 1 and the ion transport optical system 20 described above, the front-stage quadrupole mass filter 31, the collision cell (ion dissociation unit) 33 having the multipole ion guide 32 in the inside, the orthogonal acceleration unit 35, the flight space 71 including the reflector 72 in which a plurality of reflection electrodes are disposed, and an ion detector 43.

In the quadrupole-time-of-flight mass spectrometer 63, ions generated in the ionization chamber 10 are introduced into the front-stage quadrupole mass filter 31 via the ion transport optical system 20, and, for example, only an ion having a predetermined mass-to-charge ratio passes through the front-stage quadrupole mass filter 31 and is introduced into the collision cell 33 as a precursor ion. In the collision cell 33, the precursor ion comes into contact with CID gas such as nitrogen gas and is cleaved by collision-induced dissociation. The product ions generated by the cleavage are introduced into the orthogonal acceleration unit 35. The orthogonal acceleration unit 35 pulse-accelerates the introduced product ions at a predetermined timing in a direction substantially orthogonal to their traveling direction and emits them into the flight space 71. The product ions fly in the flight space 71, turn back on the reflector 72, reach the ion detector 43, and are detected.

Figure 9:
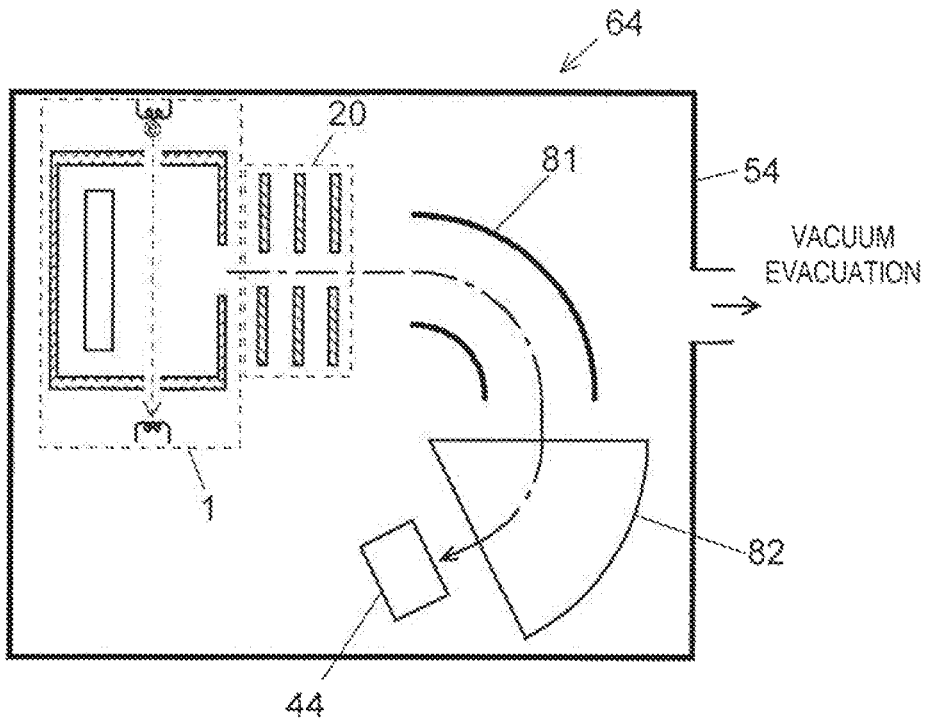
FIG. 9 is an entire configuration diagram of an electric-field/magnetic-field double-focusing mass spectrometer h is yet another embodiment of the mass spectrometer according to the present invention.

FIG. 9 is an entire configuration diagram of a magnetic-field/electric-field double-focusing mass spectrometer 64. The magnetic-field/electric-field double-focusing mass spectrometer 64 includes, inside a chamber 54 to be vacuum-evacuated, the ionizer 1 and the ion transport optical system 20 described above, an electric field sector 81 which forms a sector electric field, a magnetic field sector 82 which forms a sector magnetic field, and an ion detector 44.

In the magnetic-field/electric-field double-focusing mass spectrometer 64, ions generated in the ionization chamber 10 are introduced into the electric field sector 81 via the ion transport optical system 20, and are introduced into the magnetic field sector 82 after variation in kinetic energy of the ions is corrected by a sector electric field formed in the electric field sector 81. In the magnetic field sector 82, for example, an ion having a predetermined mass-to-charge ratio is selected from other ions by a sector magnetic field formed in the magnetic field sector 82, reaches the ion detector 44, and is detected. Note that FIG. 9 shows the configuration in which ions pass through the electric field sector 81 and the magnetic field sector 82 in this order. However, the configuration may be such that ions pass through the magnetic field sector 82 and the electric field sector 81 in this order.

REFERENCE SIGNS LIST

1 . . . Ionizer
10 . . . Ionization Chamber
10*a*, 10*b* . . . Electron Beam Passage Opening
10*c* . . . Ion Outlet
11, 12 . . . Filament
13 . . . Repeller Electrode
14 . . . Sample Gas Introduction Port
15 . . . Voltage Application Unit
20 . . . Ion Transport Optical System
30 . . . Quadrupole Mass Filter
31 . . . Front-Stage Quadrupole Mass Filter
32 . . . Multipole Ion Guide
33 . . . Collision Cell
34 . . . Rear-Stage Quadrupole Mass Filter
35 . . . Orthogonal Acceleration Unit
40 to 44 . . . Ion Detector
50 to 54 . . . Chamber
60 . . . Quadrupole Mass Spectrometer
61 . . . Triple Quadrupole Mass Spectrometer
62 . . . Time-of-Flight Mass Spectrometer
63 . . . Quadrupole-Time-of-Flight Mass Spectrometer

64 . . . Magnetic-Field/Electric-Field Double-Focusing Mass Spectrometer
71 . . . Flight Space
72 . . . Reflector
81 . . . Electric Field Sector
82 . . . Magnetic Field Sector

The invention claimed is:

1. An ionizer that ionizes sample gas by electron ionization comprising:

a) an ionization chamber;

b) a sample gas introduction port provided in the ionization chamber for introducing sample gas;

c) an electron beam emitting section which emits an electron beam toward the ionization chamber, molecules of the sample gas being ionized by coming into contact with electrons of the electron beam;

d) an electron beam passage opening which is formed on a path of the electron beam emitted from the electron beam emitting section in a wall of the ionization chamber and has a length in a direction of the path longer than a width of a cross section orthogonal to the direction; and e) an ion outlet provided in the ionization chamber for emitting an ion of the sample gas generated by coming into contact with the electrons;

wherein when a cross-sectional shape of the electron beam passage opening is circular, the width of the cross section orthogonal to the direction is defined as a diameter of the circular shape of the cross-sectional shape, and when the cross-sectional shape of the electron beam passage opening is not circular, the width of the cross section orthogonal to the direction is defined as a diameter of a circle having an area having the same as an area of the cross-sectional shape of the electron beam passage opening.

2. The ionizer according to claim 1, further comprising at least one more electron beam passage opening, wherein two of the electron beam passage openings are symmetrically formed with a center of internal space of the ionization chamber between them.

3. The ionizer according to claim 1, further comprising a repeller electrode for forming a pushing electric field for pushing an ion in a direction toward the ion outlet inside the ionization chamber.

4. A mass spectrometer, comprising:

the ionizer according to claim 1;

a mass separation unit which separates an ion generated by the ionizer according to a predetermined mass-to-charge ratio; and a detector which detects an ion separated by the mass separation unit.

5. A mass spectrometer, comprising:

the ionizer according to claim 1;

a quadrupole mass filter which separates ions generated by the ionizer according to a mass-to-charge ratio; and a detector which detects an ion separated by the quadrupole mass filter.

6. A mass spectrometer, comprising:

the ionizer according to claim 1;

a front-stage quadrupole mass filter which separates ions generated by the ionizer according to a mass-to-charge ratio;

an ion dissociation unit which dissociates an ion selected by the front-stage quadrupole mass filter;

a rear-stage quadrupole mass filter which separates a product ion generated by dissociation in the ion dissociation unit according to a mass-to-charge ratio; and a detector which detects an ion separated by the rear-stage quadrupole mass filter.

7. A mass spectrometer, comprising:

the ionizer according to claim 1;

a time-of-flight mass separation unit in an orthogonal acceleration system which separates ions generated by the ionizer according to a mass-to-charge ratio; and a detector which detects an ion separated by the time-of-flight mass separation unit.

8. A mass spectrometer, comprising:

the ionizer according to claim 1;

a quadrupole mass filter which separates ions generated by the ionizer according to a mass-to-charge ratio;

an ion dissociation unit which dissociates an ion selected by the quadrupole mass filter;

a time-of-flight mass separation unit in an orthogonal acceleration system which separates a product ion generated by dissociation in the ion dissociation unit according to a mass-to-charge ratio; and a detector which detects an ion separated by the time-of-flight mass separation unit.

9. A mass spectrometer, comprising:

the ionizer according to claim 1;

a double-focusing mass separation unit which separates ions generated by the ionizer according to a mass-to-charge ratio by a sector magnetic field and a sector electric field; and a detector which detects an ion separated by the double-focusing mass separation unit.

10. The ionizer according to claim 1, wherein the electron beam passage opening has a length in a direction of the path longer that is greater than a widest width of the electron beam passage opening in a cross section orthogonal to the direction.

11. The ionizer according to claim 1, wherein the length of the electron beam passage opening in the direction of the path is longer than widths of both cross sections orthogonal to the direction of the path length.

12. The ionizer according to claim 1, wherein the electron beam passage opening is a single opening.

* * * * *